US006319027B1

(12) United States Patent
Pickles et al.

(10) Patent No.: US 6,319,027 B1
(45) Date of Patent: Nov. 20, 2001

(54) CARD EDGE CONNECTOR WITH EJECTOR

(75) Inventors: Charles S. Pickles, York, PA (US); Hung-Chi Yu, Hsi-Chih (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/835,921

(22) Filed: Apr. 10, 2001

(51) Int. Cl.[7] ..... H01R 13/62
(52) U.S. Cl. ..... 439/157; 439/160
(58) Field of Search ..... 439/152, 153, 439/154, 155, 157, 159, 160, 377

(56) References Cited

U.S. PATENT DOCUMENTS 5,957,708 * 9/1999 Lin ..... 439/157
5,980,282 * 11/1999 Cheng ..... 439/157
6,219,251 * 4/2001 Wang ..... 439/377

* cited by examiner

*Primary Examiner*—Tho D. Ta
(74) *Attorney, Agent, or Firm*—Wei Te Chung

(57) ABSTRACT

A card edge connector (1) for receiving a daughter board (5) therein comprises an elongated insulative housing (2) and a pair of ejectors (4) assembled on the insulative housing. The insulative housing comprises a central receiving channel (21) for receiving the daughter board therein, and a pair of towers (24) positioned at two opposite ends thereof. Each tower includes a pair of opposite guide walls (25) defining a slot (26) therebetween. The ejectors being movably received in the slot of the tower, each include a header (43) on a top thereof. The header comprises a locker (48) extending toward the receiving channel for securely retaining the daughter board in the central receiving channel, and a pair of arms (45) extending opposite to the locker. The arms each include a retention protrusion (47) engaging with the guide wall for preventing the ejector moving from a secured position to a released position.

12 Claims, 5 Drawing Sheets

CARD EDGE CONNECTOR WITH EJECTOR

BACKGROUND OF THE INVENTION

1. Field of the Invention

The present invention relates to a card edge connector, and particularly to a VRM (Voltage Regulate Module) connector having an ejector at an end of a housing.

2. Description of Related Art

U.S. Pat. Nos. 5,780,463 and 5,746,614 disclose a card edge connector having a pair of ejectors at two opposite ends for ejection of a daughter board inserted therein FIG. 6 shows a conventional card edge connector 7 having an ejector 8. The card edge connector 7 comprises an insulative housing 9 which defines a central receiving channel 90 for receiving a daughter board (not shown). Two spaced guide walls 91 are formed on each longitudinal end of the insulative housing 9. Each of the guide walls 91 defines a pivot hole 92 for receiving a pivot spindle 81 of the ejector 8 thereby allowing the ejector 8 to be movable with respect to the guide walls 91 between a secured position and a released position. Projections 82 are formed on opposite sidewalls 80 of the ejector 8 for reliably engaging with recesses 93 defined in the guide walls 91 for retaining the ejector 7 at the secured position. A cavity 83 is defined in the ejector 8 between the sidewalls 80 for enhancing the resiliency of the ejector 8 thereby facilitating engagement between the projections 82 and the recesses 93 of the guide walls 91.

However, when the ejector 8 is subjected to vibration or shock, the ejector 8 may resiliently deform and move from the secured position to the released position so that the daughter board in the slot 90 may disengage from the insulative housing 9, therefore, the electrical connection between the connector 7 and the daughter board will be affected.

Therefore, an improved card edge connector is required to overcome the disadvantages of the conventional card edge connector.

SUMMARY OF THE INVENTION

Accordingly, the object of the present invention is to provide a card edge connector which can securely retain a daughter board therein.

In order to achieve the object set forth, a card edge connector for securing a daughter board therein comprises an elongated insulative housing and a pair of ejectors assembled on the insulative housing. The insulative housing comprises a central receiving channel for receiving the daughter board therein, and a pair of towers positioned at two opposite ends thereof. Each tower includes a pair of opposite guide walls defining a slot therebetween. The ejector is movably received in the slot of the tower and includes a header on a top thereof. The header comprises a locker extending toward the central receiving channel for securely retaining the daughter board in the central receiving channel, and a pair of arms extending opposite to the locker. The arms each include a respective retention protrusion for releasably locking to the guide walls.

Other objects, advantages and novel features of the invention will become more apparent from the following detailed description when taken in conjunction with the accompanying drawings.

DETAILED DESCRIPTION OF THE INVENTION

Figure 1:
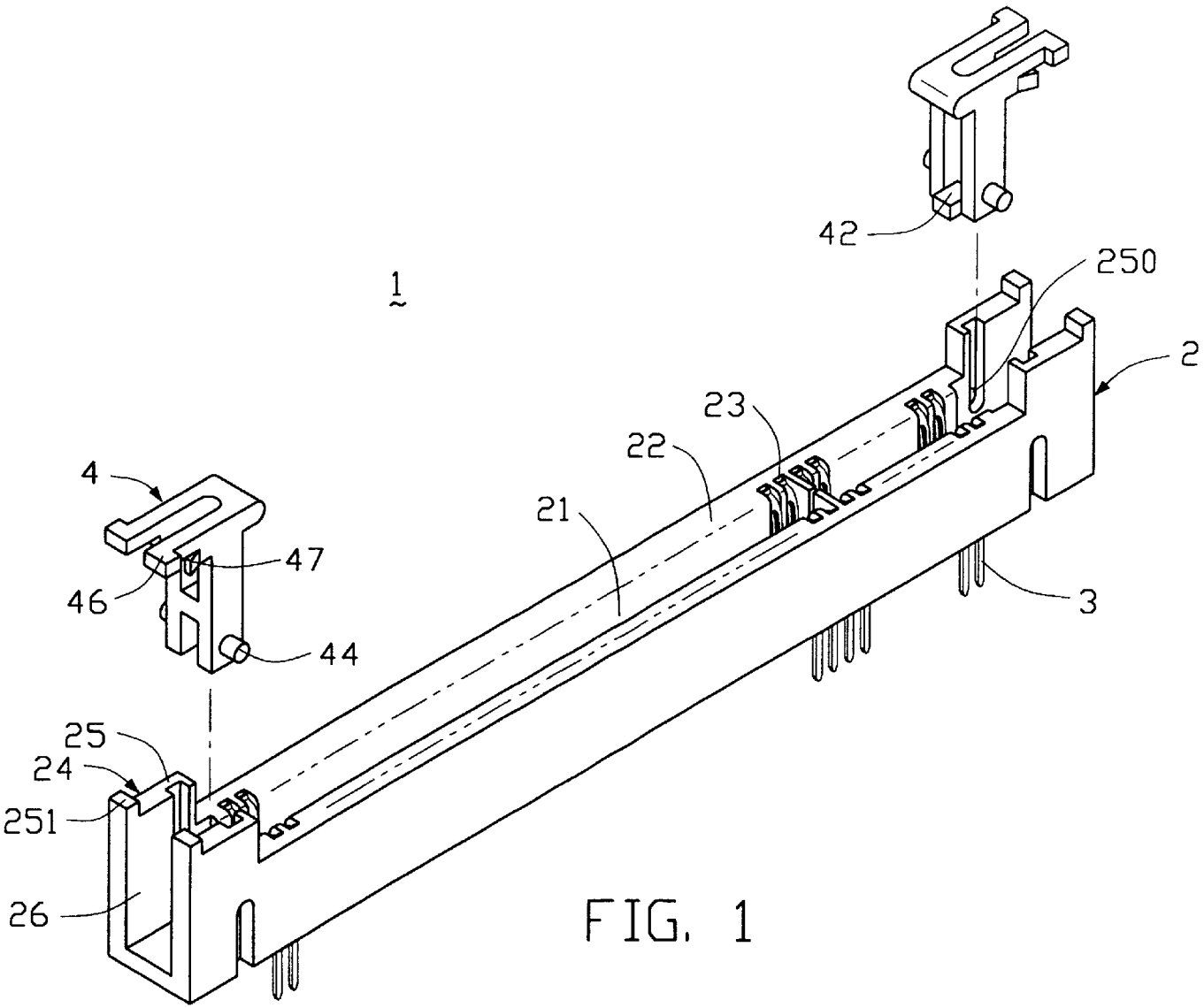
FIG. 1 is an exploded perspective view of a card edge connector in accordance with the invention.

Reference will now be made to the drawing figures to describe the present invention in detail.

Referring to FIG. 1, a card edge connector 1 of the present invention comprises an elongated insulative housing 2, a plurality of conductive contacts 3 received in the insulative housing 1, and a pair of ejectors 4 assembled on each end of the insulative housing 1.

The insulative housing 2 defines a central receiving channel 21 in a top face 22 thereof and substantially coextensive therewith for receiving a daughter board 5 therein. A plurality of receiving passageways 23 is defined in the insulative housing 2 on two sides of the receiving channel 21 for receiving and retaining the conductive contacts 3 therein. A pair of towers 24 is respectively positioned at two opposite ends of the housing 2. Each tower 24 comprises a pair of spaced guide walls 25 which define a slot 26 therebetween. Each of the guide walls 25 defines a pivot hole 250 on a lower portion thereof and a protrusion 251 extending upwardly from a top thereof.

Figure 2:
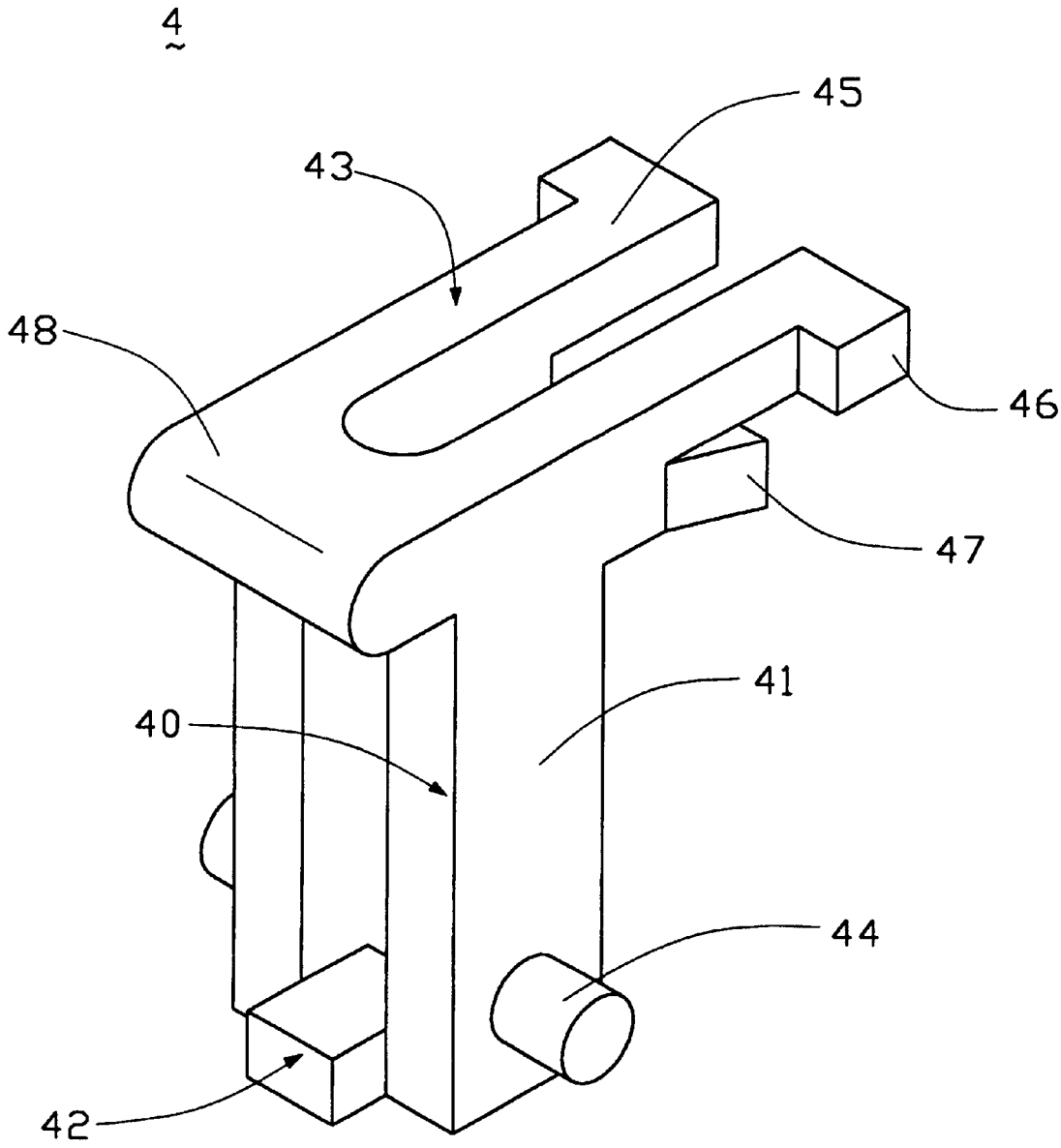
FIG. 2 is an enlarged perspective view of an ejector of the card edge connector of FIG. 1.

Referring to FIG. 2, the ejector 4 comprises an elongated main body 40 movably received in the receiving channel 26 of the tower 24. The main body 40 has a pair of opposite sidewalls 41 each having a spindle 44 on a lower portion thereof for being pivotally received in a corresponding hole 250 of the guide wall 25 thereby allowing the ejector 4 to be movable between a secured position and a released position. The main body 40 includes a kicker 42 extending toward the receiving channel 21 from a bottom thereof, and a header 43 on a top thereof. The header 43 includes a locker 48 extending toward the receiving channel 21 and a pair of elastic arms 45 extending opposite to the locker 48. Each arm 45 comprises a flange 46 extending outwardly from a free end thereof. A wedge-shaped retention protrusion 47 extends outwardly from the elastic arm 45. It should be known that the distance between the retention protrusions 47 is relatively greater than the distance between the opposite protrusions 251 of the tower 24.

Figure 3:
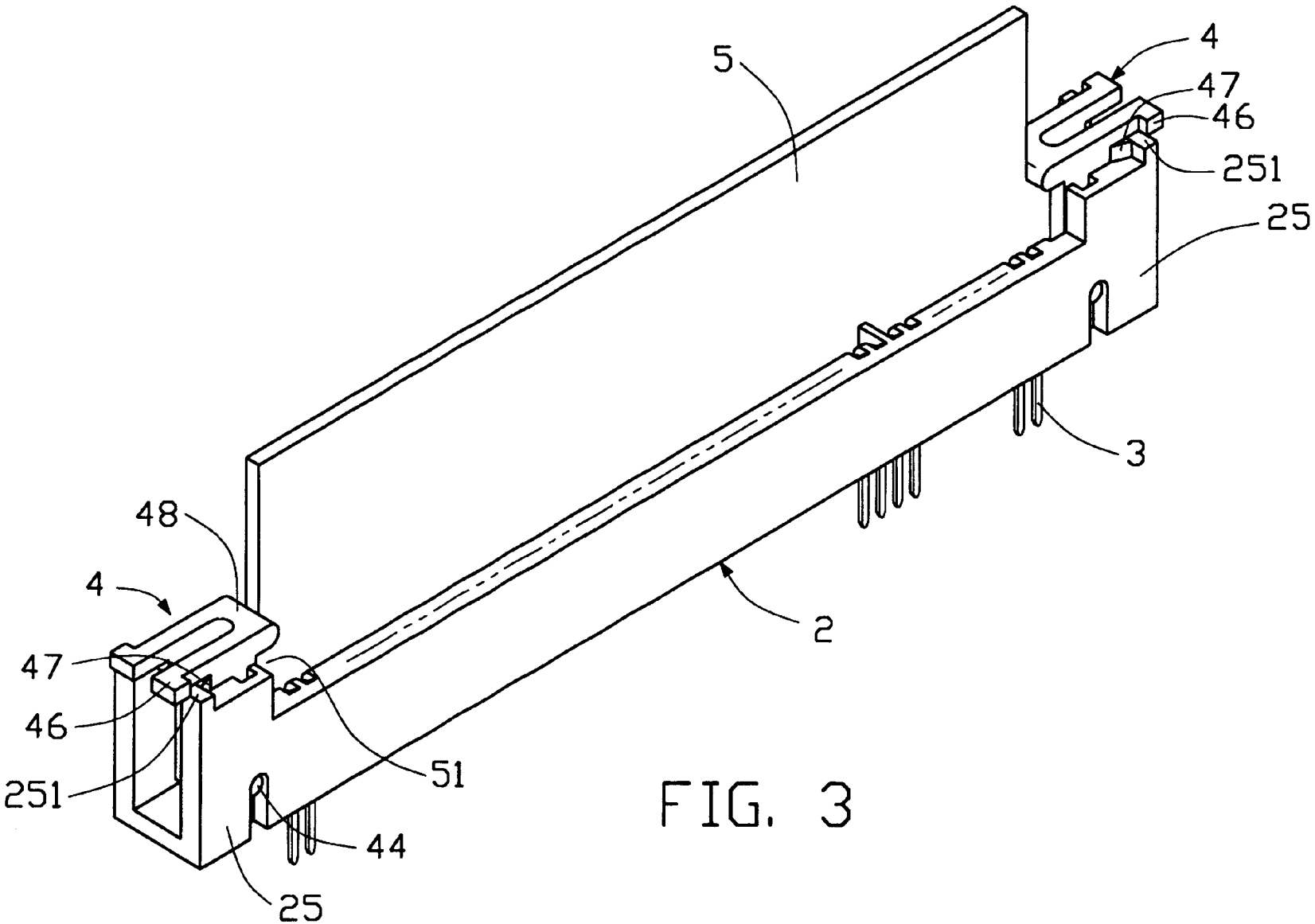
FIG. 3 is an assembled perspective view of the card edge connector of FIG. 1 and a daughter board.
Figure 4:
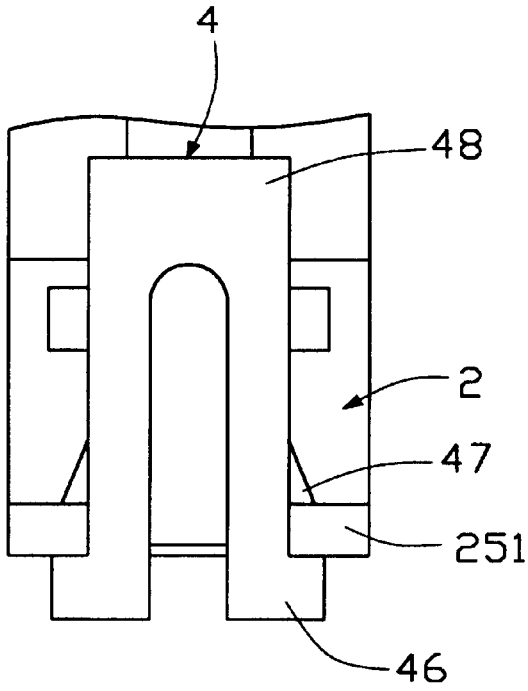
FIG. 4 is an enlarged bottom view of the ejector in a secured position.
Figure 5:
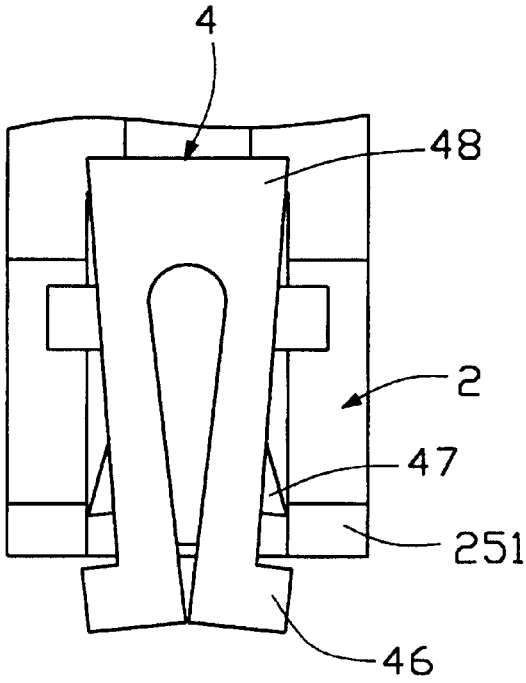
FIG. 5 is an enlarged bottom view of the ejector being changed from the secured position to a released position.
Figure 6:
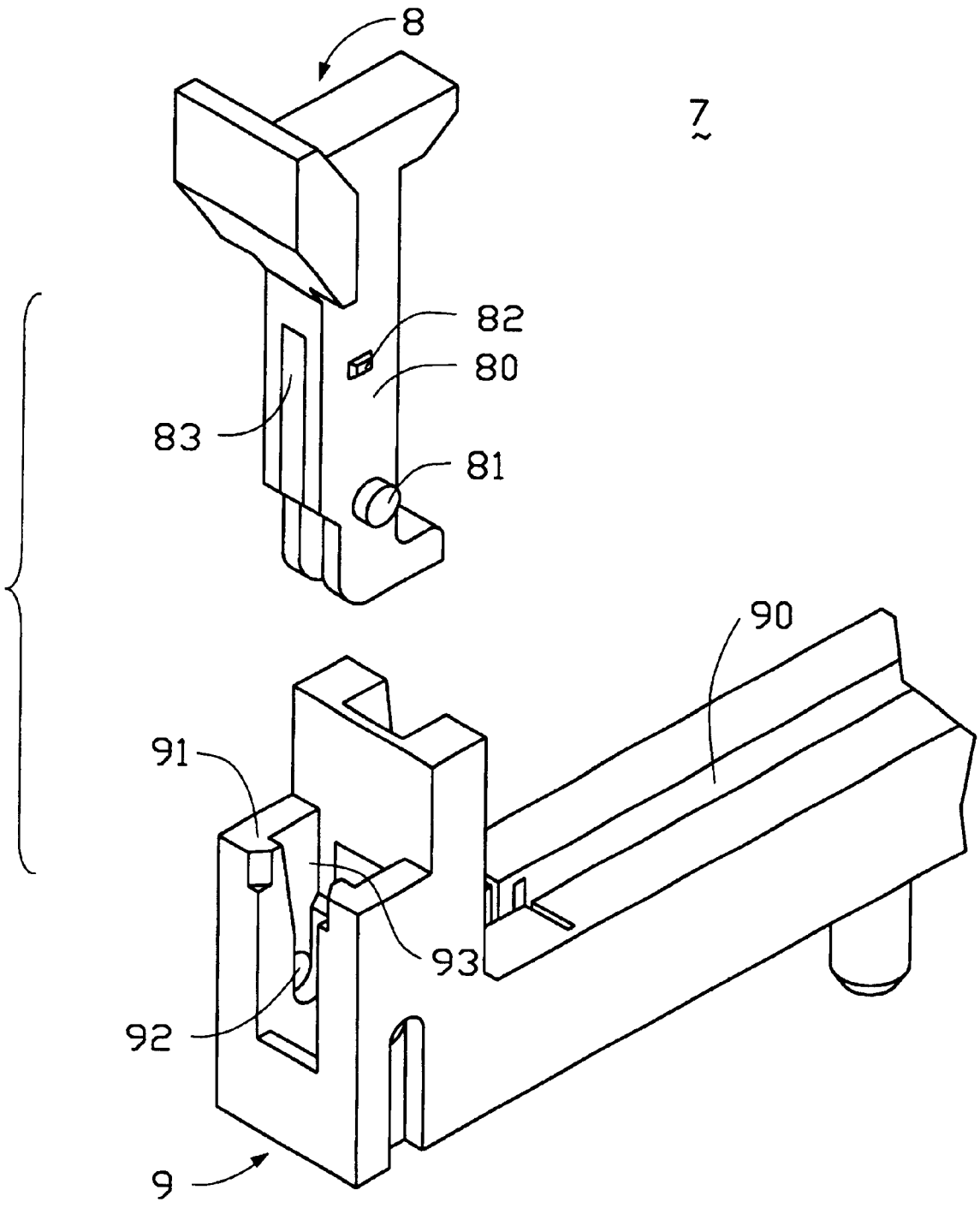
FIG. 6 (PRIOR ART)
FIG. 6 is an exploded perspective view of a card edge connector according to the prior art.

In assembly, referring to FIG. 3, the daughter board 5 is inserted into the central receiving channel 21 to establish an electrical connection with the conductive contacts 3, with the locker 48 engaging with a protrusion 51 of the daughter board 5 for securing the daughter board 5 in the central receiving channel 21. Referring to FIG. 4 and FIG. 5, when the ejector 4 is in the secured position, the retention protrusion 47 of the ejector 4 engages with the protrusion 251 of the tower 24 for preventing the ejector 4 from moving outwardly to the released position. When the connector 1 is subjected to vibration or shock, the ejector 4 remains securely retained in the secured position and the daughter board 5 is securely mounted in the central receiving channel 21. As the flanges 46 of the ejector 4 are manually pressed inwardly, the distance between the retention protrusions 47 of the ejector 4 becomes smaller than the distance between the protrusions 251 of the tower 24, therefore, the ejector 4 can be moved from the secured position to the released position, and the kickers 42 of the ejectors 4 eject the daughter board 5 out of the connector 1.

It is noted that in the traditional connector, because the rotative disengagement between the ejector and the housing is directly implemented through an outward longitudinal rotation of the ejector, the traditional ejector requires to use the small dimples or tapered protrusions thereon to engage the guide walls for holding the ejector in a vertical locking position while still allowing outward rotation of the ejector without interference or obstacle. Differently, in the invention because a lateral inward movement is implemented on the ejector which allows the ejector to be easily disengaged from the housing, the retention protrusion 47 can be arranged in a form of triangle using a relative larger abutment surface, in comparison with the traditional connector, to efficiently latchably abut against the corresponding guide wall 25 without the interference problem during ejecting the daughter board. Understandably, in the invention without manually applying a lateral inward depression to the elastic arm 45 to intentionally lateraly move the retention protrusion 47, pure traditional outwardly longitudinally rotatively moving the ejector relative to the tower, can not move the ejector due to the enhanced abutment surface against the guide wall in comparison with the traditional connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector adapted for receiving a daughter board therein, comprising:

an elongated insulative housing defining a central receiving channel for receiving a daughter board therein, the insulative housing comprising a pair of towers positioned at two opposite ends thereof, each tower including a pair of opposite guide walls defining a slot therebetween; and a pair of ejectors each including an elongated main body pivotably received in the slot of the tower and a header on a top of the main body, the header comprising a locker extending toward the central receiving channel for securely retaining the daughter board in the central receiving channel and a pair of elastic arms formed on the header and extending opposite to the locker, the arms each including a retention protrusion releasably engaged with a corresponding guide wall.

2. The card edge connector as described in claim 1, wherein the ejector includes a kicker extending horizontally toward the central receiving channel for ejecting the daughter board from the connector.

3. The card edge connector as described in claim 1, wherein the ejector comprises a pair of spindles on respective bottoms of opposite sidewalls thereof, and the tower includes a pair of pivot holes on respective lower portions of the guide walls for receiving the spindles.

4. The card edge connector as described in claim 1, wherein each of the sidewall includes a pair of protrusions on a top thereof for engaging with the retention protrusion of the ejector.

5. The card edge connector as described in claim 1, wherein the retention protrusion is wedge-shaped.

6. An ejector for retaining a daughter board in a card edge connector, comprising:

a main body having a pair of opposite sidewalls, each sidewall comprising a spindle for being pivotally received in the card edge connector;

a kicker positioned at a bottom portion of the main body for ejecting the daughter board from the card edge connector;

a locker extending from a top of the main body toward the daughter board for securely retaining the daughter board in the card edge connector; and a pair of elastic arms extending from the top and opposite to the locker, each arm including a retention protrusion engaged with the connector for preventing the ejector from moving from a retaining position to a released position.

7. The ejector as described in claim 6, wherein each arm includes a flange extending outwardly from an end thereof for handling by hands.

8. A card edge connector comprising:

an elongated housing defining a central receiving channel, at least one tower positioned at one end of the housing, said tower providing at least one guide wall thereof; and at least one ejector rotatably disposed in said tower, said ejector including a main body with a locker on an upper portion for securely retaining a daughter board in the central receiving channel; wherein a retention protrusion is formed on said ejector with thereon an abutment surface latchably engaged with the guide wall, and said ejector includes an elastic portion on the upper portion and extending opposite to the locker, said elastic portion is manually depressed along a first direction to actuate the retention protrusion to move along said first direction for disengagement from the guide wall.

9. The connector as described in claim 8, wherein said ejector is rotatable relative to the housing along a second direction thereof.

10. The connector as described in claim 9, wherein said first direction and said second direction are perpendicular to each other.

11. The connector as described in claim 10, wherein said abutment surface is enhanced to be large enough to efficiently latchably engage the guidewall even a traditional rotation force being imposed on the ejector along the second direction, if no force is imposed on said elastic portion along the first direction.

12. A method of two-step release of a daughter board from a connector, comprising the steps of:

providing a housing with a central receiving channel and two towers at two opposite ends thereof, each of said towers defining at least one guide wall; providing an ejector rotatably received in each of said towers, each of the ejector defining a main body with a locker at an upper portion thereof, and at least one retention protrusion is formed on the ejector, and the ejector includes an elastic portion extending opposite to the locker and engaged with or disengaged from the corresponding guide wall;

providing the daughter board latchably received within the central receiving channel by the locker of each of said ejectors;

when releasing the daughter board from the housing, first along a first direction depressing the elastic portion to release the retention protrusion from the guide wall, and secondly along a second direction rotatably moving the ejector to remove engagement between the daughter board and the locker of each of said ejectors wherein said first direction and said second direction are perpendicular to each other.

* * * * *